United States Patent [19]

Iwamasa

[11] Patent Number: 4,891,671

[45] Date of Patent: Jan. 2, 1990

[54] MAGNETIC BRUSH DEVELOPING DEVICE

[75] Inventor: Akiyoshi Iwamasa, Zama, Japan

[73] Assignee: Fujitsu Limited, Kawasaki, Japan

[21] Appl. No.: 204,907

[22] Filed: Jun. 10, 1988

[30] Foreign Application Priority Data

Jun. 10, 1987 [JP] Japan ..... 62-144274

[51] Int. Cl.[4] ..... G03G 15/09

[52] U.S. Cl. ..... 355/245; 355/251; 118/657

[58] Field of Search ..... 355/3 DD, 14 D, 3 R, 355/245, 251, 260; 118/656–658, 653

[56] References Cited

U.S. PATENT DOCUMENTS 4,439,034 3/1984 Daniels ..... 355/3 DD

FOREIGN PATENT DOCUMENTS 0111669 6/1984 European Pat. Off. .
0159721 10/1985 European Pat. Off. .
52-32337 11/1977 Japan ..... 355/3 DD
57-30874 2/1982 Japan .
59-2057 1/1984 Japan .
59-131955 7/1984 Japan .
549824 5/1974 Switzerland .
2150052 6/1985 United Kingdom .

OTHER PUBLICATIONS

IBM Technical Disclosure Bulletin, vol. 28, No. 1, Jun. 1985, "Developer Mix Shut-Off Gate", p. 396.

*Primary Examiner*—Arthur T. Grimley
*Assistant Examiner*—J. Pendegrass
*Attorney, Agent, or Firm*—Staas & Halsey

[57] ABSTRACT

A developing device includes a developing agent holding vessel; and a developing roller having a rotating non-magnetic sleeve and a magnetic roller which is surrounded by the sleeve and has magnetic poles. A blade is disposed at an outlet of the vessel and a stirring roller stirs the developing agent which includes a toner and a carrier in the vessel. The developing roller is provided with a moving mechanism for shifting the position of the magnetic pole of the magnetic roller, wherein one of the magnetic poles is facing a surface of a photosensitive drum during normal use of the developing agent, and no magnetic pole faces the photosensitive surface during a replacement of the developing agent.

12 Claims, 11 Drawing Sheets

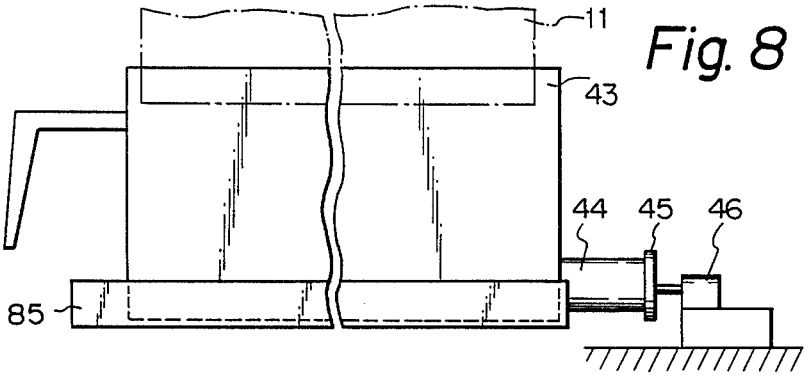
Fig. 8
Fig. 9
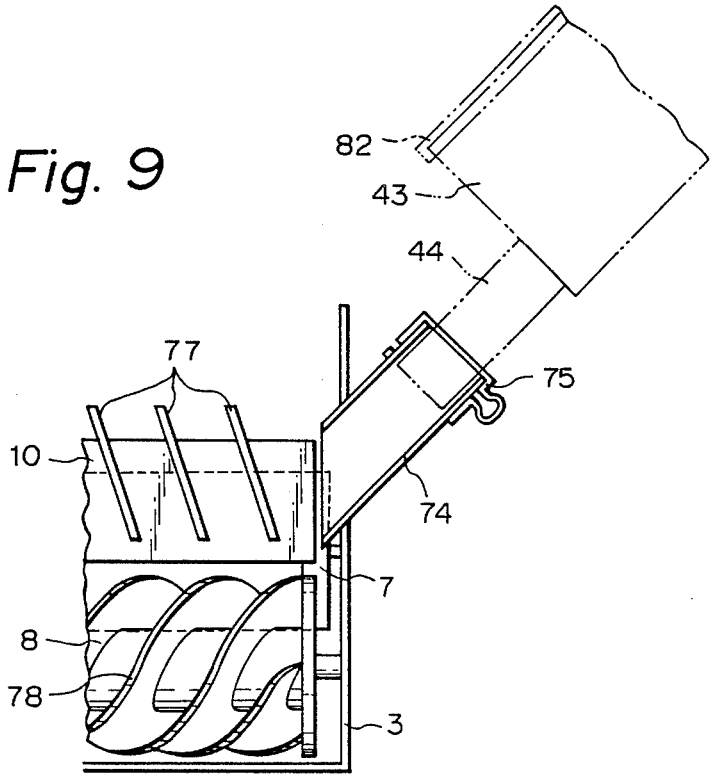

MAGNETIC BRUSH DEVELOPING DEVICE

BACKGROUND OF THE INVENTION

1. Field of the Invention

The present invention relates to a developing device of an electrographic recording apparatus, a laser printer, and the like.

2. Description of the Related Art

The conventional electrophotographic apparatus adopts a magnetic brush development system, in which a developing agent (i.e., two-component developer) comprised of a toner and a carrier is used to develop electrostatic latent images formed on a photosensitive body (drum). The toner is consumed during this process, and thus fresh toner must be supplied periodically, and when the end of the predetermined service life of the carrier is reached, the used carrier must be replaced by fresh carrier. Accordingly, the used developing agent comprised of the carrier and the toner is removed (exhausted) from the developing device, and collected in a suitable container. During the removal of the developing agent, the surface of the photosensitive drum can be easily damaged, and this must be prevented.

A conventional developing device and the operation thereof are now explained with reference to FIG. 1.

As shown in FIG. 1, the developing device 2 is arranged adjacent to a photosensitive drum 1 and comprises a developing agent holding vessel 3, a toner holding vessel 4, a toner feeding roller 17, a developing roller 7, and a stirring roller 8. The toner and carrier (magnetic material powder) are mixed in the vessel 3 by the stirring roller 8, so that the toner and carrier are given electrostatic charges by friction and the charges are uniformly distributed, to form a developing agent. The developing roller (i.e., magnetic roller) 7 is composed of a rotatable non-magnetic sleeve 6 and a stationary magnetic roller 5 surrounded by the sleeve 6; an air gap being formed between the sleeve 6 and the roller 5. The magnetic roller 5 has several magnetic poles, for example, 5 poles, (three N-poles and two S-poles) and one of N-poles is arranged to face the photosensitive drum 1. The developing agent is fed to the developing roller 7 by the stirring roller 8 and is then adsorbed on the surface of the non-magnetic sleeve 6 due to the magnetic force thereof. The adsorbed agent is carried toward a developing zone by the rotation of the sleeve 6, in a direction A, and on the way to the developing zone, a blade 9 cuts the adsorbed developing agent to a predetermined uniform height and the cut (excess) agent flows through a flow regulating plate 10 and is returned to the developing agent holding vessel 3. When the developing agent reaches the developing zone, i.e., the position at which the magnetic pole is facing the photosensitive drum, the height of the developing agent is increased (i.e., a developing agent brush is formed) by the magnetic force, to bring the agent into contact with the surface of the drum. In addition, a developing bias voltage is applied between the non-magnetic sleeve 6 and the photosensitive drum 1, whereby the toner of the developing agent adheres to an electrostatic latent image formed on the drum 1 to form a developed image. After development, the developing agent is carried further by the rotation of the sleeve 6 and then allowed to drop down, due to a weak magnetic force portion of the developing roller 7, under its own weight and return to the vessel 3.

The toner is consumed during the movement thereof from the developing device 2 to the photosensitive drum 1, and to maintain a desired toner concentration, new toner is periodically fed from the toner vessel 4 through the toner feeding roller 17, but the carrier is continuously used in the developing device until the end of a predetermined service life thereof. When the developing agent containing the expired carrier is removed from the developing agent holding vessel 3, a lid 11 covering an opening 18 at a lower portion of the vessel 3 is opened and the stirring roller 8 and the developing roller 7 are rotated to cause the agent to flow out through the opening 18. In this case, the portion (i.e., magnetic brush) of the developing agent comes into pressurized contact with the surface of the photosensitive drum 1, which does not rotate, and thus the contact surface portion of the drum 1 is damaged. Therefore, to prevent this damage, the developing agent must be separated from the photosensitive drum 1. To accomplish this separation, the developing device 2 is moved away from the drum 1. For example, the device 2 is supported by a holding base 12 which can be swung about a fulcrum 13 with the aid of a cam 14. The base 12 is forced into contact with the cam 14 by a spring 15 and is swung by the rotation of the cam 14. The cam 14 is driven by operating a lever 16 by hand, to move the device 2. This moving mechanism complicates the structure of the developing device, and further, since the heavy developing device 2 (8–10 kg) must be manually moved by the lever 16, an increased labor force becomes necessary.

SUMMARY OF THE INVENTION

An object of the present invention is to provide a simple system by which the developing agent brush is easily separated from the photosensitive drum surface.

Another object of the present invention is to provide an improved developing device in which the used developing agent is easily replaced by fresh agent.

These and other objects of the present invention are achieved by a developing device comprising a developing agent holding vessel; a developing roller consisting of a rotating non-magnetic sleeve and a magnetic roller surrounded by the sleeve and having magnetic poles; a blade disposed at an outlet of the developing agent holding vessel for uniformizing a feed quantity of a developing agent consisting of a toner and a carrier; and a stirring roller for stirring the developing agent in the developing agent holding vessel. According to the present invention, the developing roller is provided with a moving means for shifting the positions of the magnetic poles of the magnetic roller, whereby one of the magnetic poles confronts a surface of a photosensitive drum during normal use of the developing agent and none of the magnetic poles confronts the photosensitive surface during a replacement of the developing agent.

At the position at which the developing device is operated, i.e., the developing agent is used, one of the magnetic poles of the magnetic roller is arranged to confront the photosensitive surface, in the same manner as in a conventional device, so that a developing agent brush is formed by the effect of the magnetic pole and comes into contact with the photosensitive surface, and as a result, toner contained in the developing agent is efficiently transferred to an electrostatic latent image on the photosensitive surface, and the toner on the developed imaged is transferred to a paper. The toner of a residual developed image is cleaned from the photosensitive surface, and thus the toner is consumed. To maintain the concentration of the toner of the developing agent at a certain value, toner in the toner holding vessel is fed into the developing agent holding vessel through a toner feeding roller.

The carrier of the developing agent is not consumed during use but has only a certain service life, and when this service life is completed, the expired carrier (i.e., the developing agent including the carrier) is removed from the developing agent holding vessel. At this time, according to the present invention, the position of the magnetic pole confronting the photosensitive surface during the use of the developing agent is shifted by moving the magnetic roller, so that the brush of the developing agent does not come into contact with the photosensitive surface. Namely, the brush (i.e., a heightened portion) of the developing agent generated by the magnetic force of the magnetic pole is shifted from the confrontation position to a position in contact with the photosensitive drum by moving the magnetic pole. This movement of the magnetic pole is performed by rotating the magnetic roller provided with the magnetic pole by a moving means. In this state, a lid for an opening formed at a lower portion of the developing agent holding vessel is opened, and the developing roller and the stirring roller are rotated to discharge the developing agent through the opening, and accordingly, no damage occurs to the photosensitive surface.

Preferably, the moving means for the magnetic roller is a lever fixed on the magnetic roller and swinging about the axis of the magnetic roller.

Also preferably, another of the magnetic poles is located at a position confronting the blade during the replacement of the developing agent. In this case, the brush of the developed agent formed by this magnetic pole is cut by the blade, so that the quantity of agent carried to the developing zone is decreased, compared with a conventional device, whereby the brush height of the developing agent and the thickness of the developing agent layer, except for the magnetic pole position, are also decreased. This ensures that developing agent brush does not come into contact with the photosensitive surface.

BRIEF DESCRIPTION OF THE DRAWINGS

The present invention will be more apparent from the description of the preferred embodiments set forth below with reference to the accompanying drawings, in which

FIG. 8 is a partial side view of a container and a microswitch;

FIG. 9 is a schematic partial view of the developing device according to the present invention for showing a charging pipe;

DESCRIPTION OF THE PREFERRED EMBODIMENTS

Figure 1:
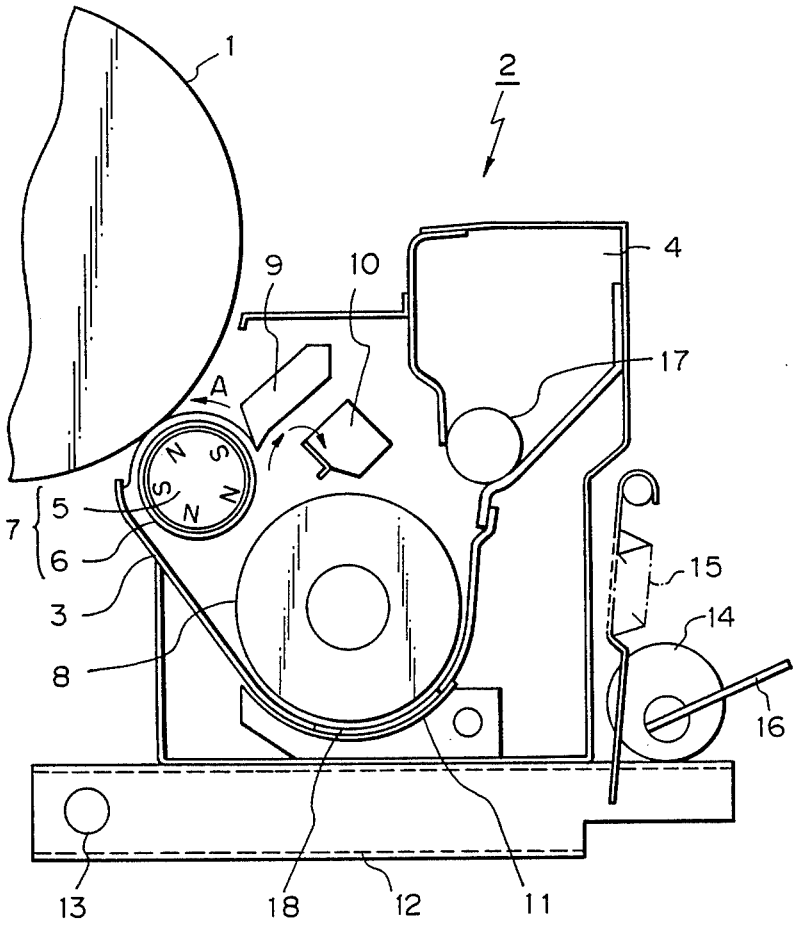
Fig. 1 PRIOR ART
FIG. 1 is a schematic view of a conventional developing device.
Figure 2:
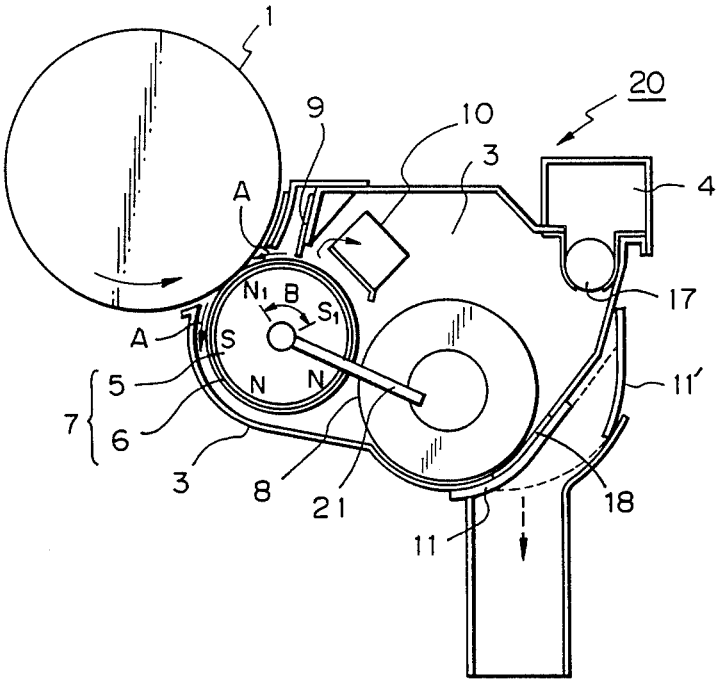
FIG. 2 is a schematic view of a developing device according to the present invention during the use of the developing agent.

Referring to FIG. 2, a developing device 20 according to the present invention is set adjacent to a photosensitive drum 1 in a usual manner. The developing device 20 comprises a developing agent holding vessel 3, a toner holding vessel 4, a developing roller 7 consisting of a magnetic roller 5 and a rotating nonmagnetic sleeve 6, a stirring roller 8, a blade 9, a flow regulating plate 10, a lid 11 for an opening 18, and a toner feeding roller 17. The same reference numerals as those in FIG. 1 are used to indicate the same members. According to the present invention, the magnetic roller 5 is rotatably set in the non-magnetic sleeve 6, and is provided with the lever 21 fixed thereon and swung about the axis of the roller 5. In this case, the magnetic roller 5 has, for example, five magnetic poles, (three N-poles and two S-poles). One pole ($N_1$) and another pole ($S_1$) are arranged at an angle B of, e.g., about 100 degrees.

Figure 4:
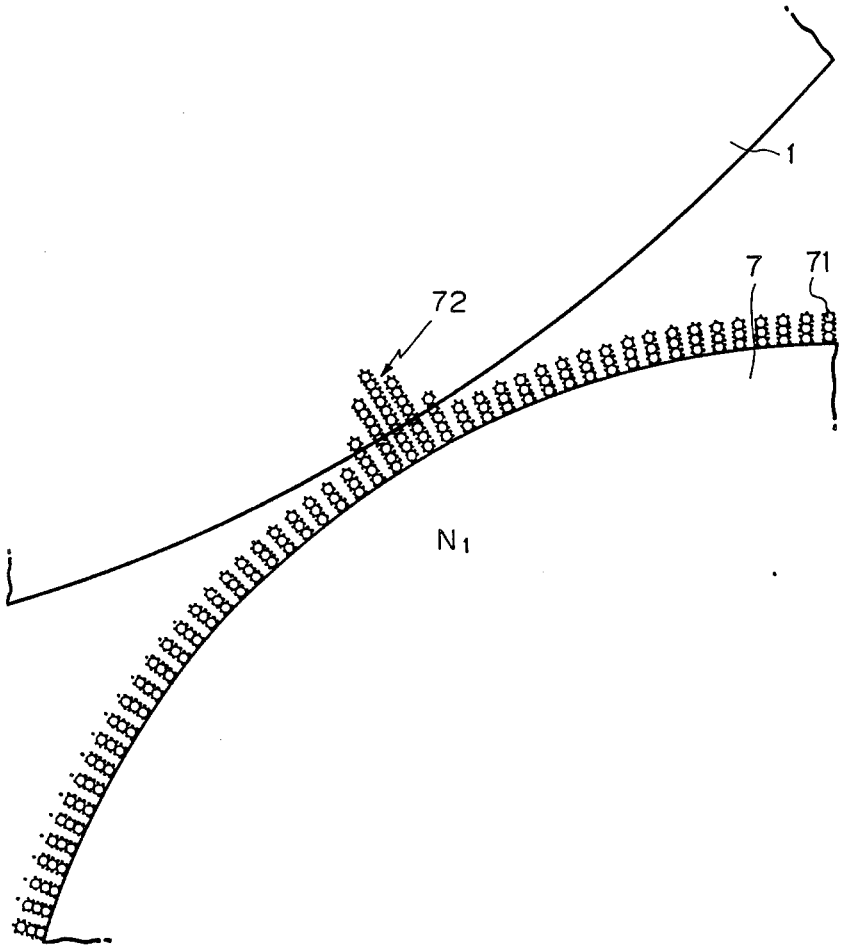
FIG. 4 is a schematic partial view showing the developing agent between the magnetic roller and the photosensitive drum during the use of the developing agent.

The developing operation of the developing device 20 is carried out in the conventional manner, under a condition that one (e.g., $N_1$) of the magnetic poles is located facing the photosensitive drum 1 and there is no magnetic pole under the blade 9, as shown in FIG. 2. Namely, the toner and carrier are mixed in the developing agent holding vessel 3 by the stirring roller 8, so that the toner and carrier are electrostatically charged. The developing agent is adsorbed on the sleeve 6 and is conveyed by the rotation of the sleeve 6 in the section A toward the photosensitive drum 1. The agent is then cut by the blade 9, to return excess agent and to bring the height (thickness) of the adsorbed agent to a certain value. At a position where the magnetic pole $N_1$ faces the photosensitive surface, the developing agent is shaped into a brush by the magnetic force of the magnetic pole $N_1$ as illustrated in FIG. 4, and as a result, the developing agent brush is brought into contact with the photosensitive surface, and thus the electrostatically charged toner in the brush is transferred onto an electrostatic latent image of the photosensitive surface, to develop the image. In FIG. 4, the developing agent layer 71 comprise magnetic material carriers (schematically indicated by small circles) and toners (schematically indicated by dots), and the developing agent brush 72 is illustrated as if it were not pressed against the surface of the drum 1. The brush is actually pressed by the surface of the drum 1, since the brush comes into contact with the drum surface.

Figure 3:
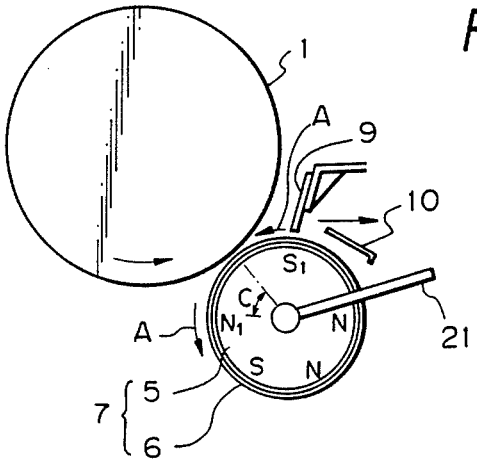
FIG. 3 is a schematic partial view of the developing device of FIG. 2 during the replacement of the developing agent.
Figure 5:
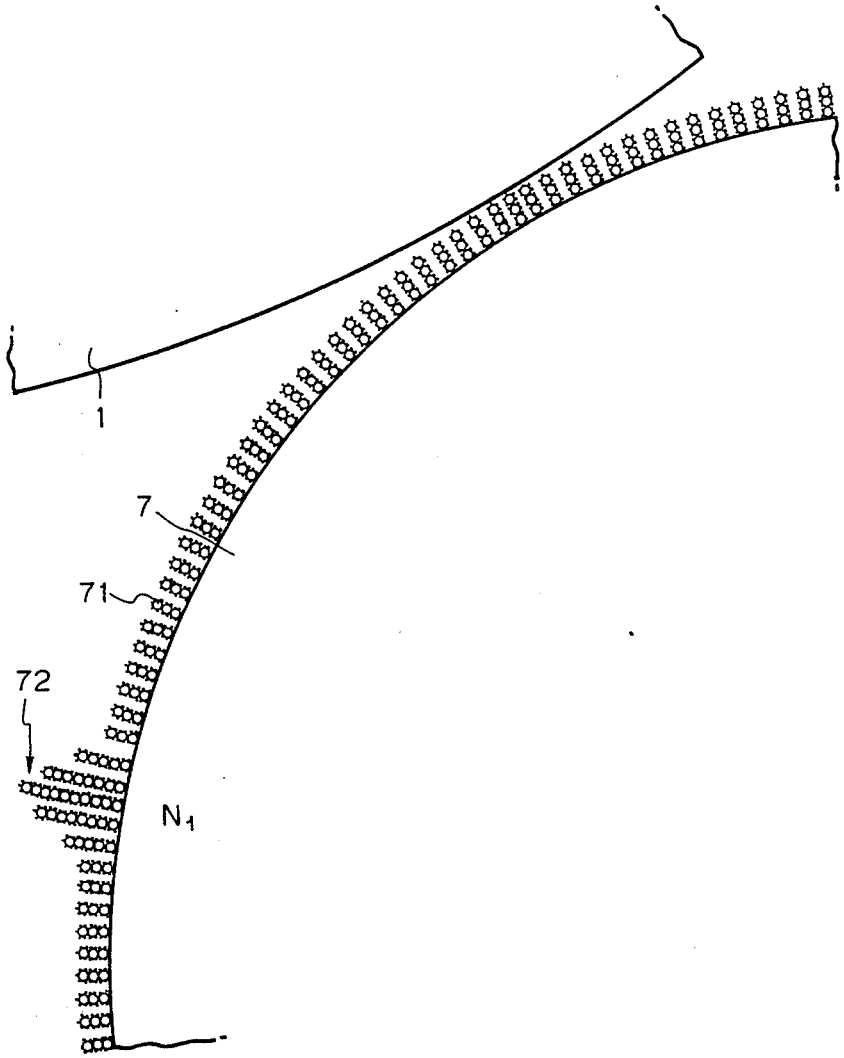
FIG. 5 is a schematic partial view showing the developing agent between the magnetic roller and the photosensitive drum during the replacement of the developing agent.

When the developing agent includes carrier that has reached the end of its service life is removed from the developing agent holding vessel 3 to be replaced with fresh carrier, the lever 21 is moved to shift the magnetic pole $N_1$ from the facing position, as shown in FIG. 3. Therefore the developing agent brush 72 formed by the magnetic pole $N_1$ is also shifted and does not come into contact with the photosensitive surface of the drum 1 (as illustrated in FIG. 5). At the same time, the other magnetic pole $S_1$ is brought under the blade 9 (at a location facing the blade). Accordingly, another developing agent brush is formed by the other magnetic pole $S_1$ and is cut by the blade, so that the quantity of the developing agent carried toward the drum 1 is decreased, which decrease the height (thickness) of the developing agent layer. After the rotation of the magnetic roller 5 by the lever 21, the lid 11 in the lower portion of the vessel 3 is opened (i.e., is moved to a position indicated by 11') and the developing roller 7 and the stirring roller 8 are rotated to discharge the developing agent through the opening 18 formed in the vessel 3. The rotation angle C (FIG. 3) of the magnetic roller 5 is, e.g., about 50 degrees. The swinging motion of the lever 21 is limited by suitable stoppers (not shown).

In addition to the above explanation, a new developing agent is prepared, in the following manner.

After the old developing agent is removed, the lid 11 is closed and fresh carrier is charged into the developing agent holding vessel 3. Then the toner feeding roller 17, the stirring roller 8, and the developing roller are rotated, so that toner is fed from the toner holding vessel 4 into the charged carrier and is mixed therewith to form a new developing agent. The lever 21 is then moved to return the magnetic pole $N_1$ to the position facing the photosensitive drum 1, as shown in FIG. 2.

The replacement of the developing agent is now explained in more detail with reference to FIGS. 6 to 12.

Figure 6:
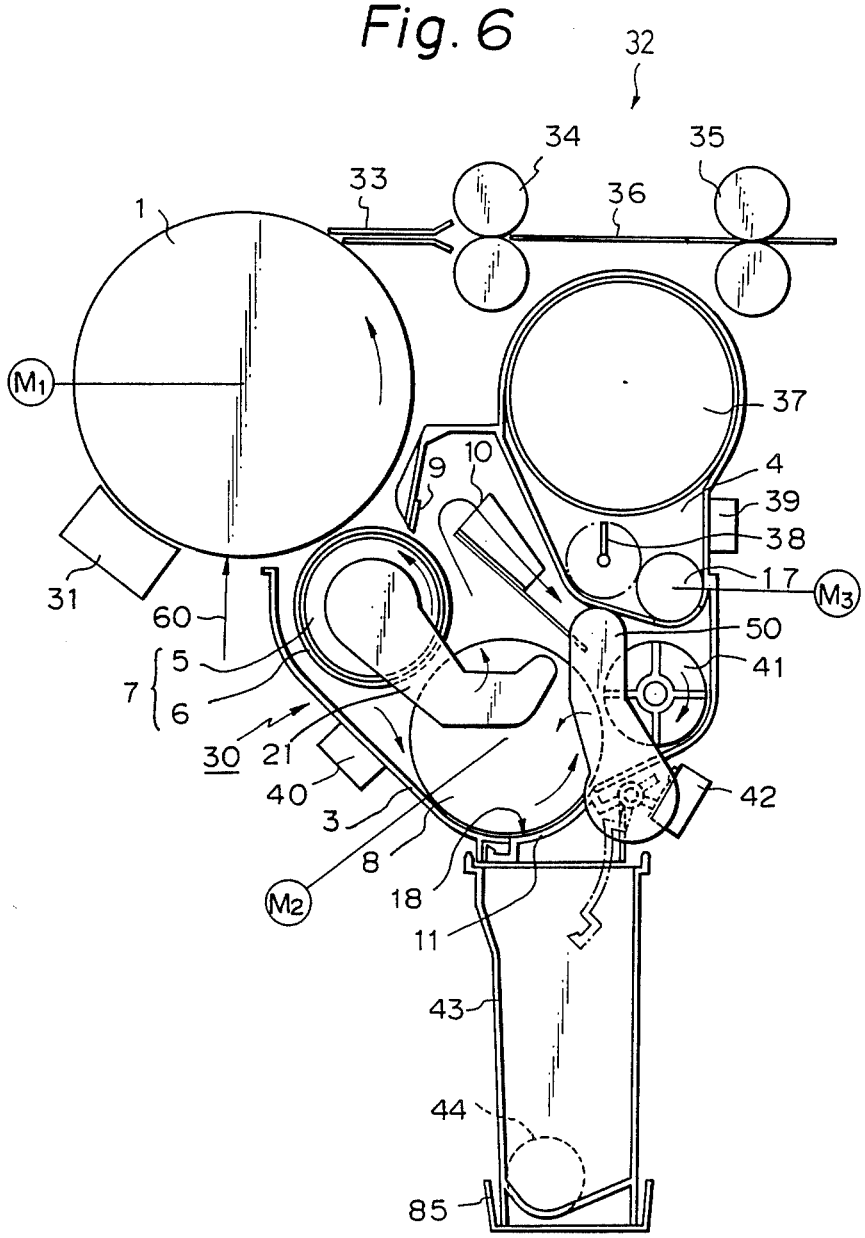
FIG. 6 is a schematic partial view of an electrophotographic printing apparatus including a developing device according to the present invention.

Referring to FIG. 6, an electrophotographic printing apparatus comprises a photosensitive drum 1 with a corona discharge device 31 and a motor $M_1$, a paper feed system 32 comprising a guide 33 and feeding rollers 34 and 35 for a paper 36, and a developing device 30 according to the present invention.

Figure 7:
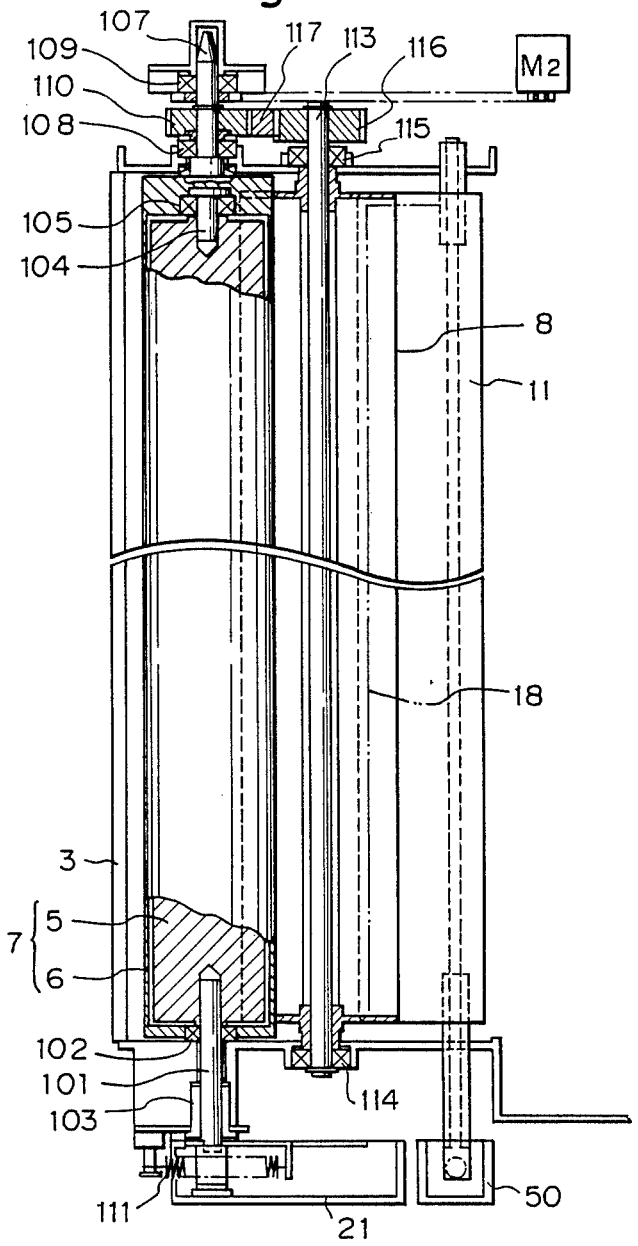
FIG. 7 is a schematic partial view of the developing device of FIG. 6 for showing a magnetic roller, a stirring roller and a lid.

The developing device 30 comprises the same members as the device 2 of FIG. 2 and these are indicated by the same reference numerals as used in FIG. 2. Namely, they comprise a developing agent holding vessel 3, a toner holding vessel 4, a developing roller 7 consisting of a magnetic roller 5 and a rotating non-magnetic sleeve 6 (FIG. 7), a stirring roller 8, a blade 9, a flow regulating plate 10, a lid 11 for an opening 18, a toner feeding roller 17, and a lever 21 fixed to the magnetic roller 5. As shown in FIG. 7, the magnetic roller 5 has a fixed center shaft 101 which extends through a ball bearing 102 of the sleeve 6 and a bearing 103 of the vessel 3 and is provided with the lever 21, and another fixed center shaft 104 which is fitted in another ball bearing 105 of the sleeve 6. The sleeve 6 has a center shaft portion 107 which extents through ball bearings 108 and 109 of the vessel 3, is provided with a gear 110, and is connected to a motor $M_2$ through a suitable transmission. Thus, the sleeve 6 only of the developing roller 7 can be rotated by the motor $M_2$ and the magnetic roller 5 only can be rotated by the lever 21. The lever 21 is provided with a suitable positioning device including a spring 111. A shaft 113 of the stirring roller 8 is rotatably set by ball bearings 114 and 115 of the vessel 3 and is provided with a gear 116. The gear 116 is connected to the gear 110 of the sleeve 6 through a gear 117, so as to simultaneously rotate the stirring roller 8 and the sleeve 6. A toner cartridge 37 (FIG. 6) is inserted in the toner holding vessel 4, and an agitator (a rotating rod) 38 and a toner sensor 39 for detecting the presence of the toner are attached to the vessel 4. A sensor 40 for detecting a toner concentration and an additional stirring roller 41 are attached to the developing agent holding vessel 3. A motor $M_3$ for rotating the toner feeding roller 17 and the agitator 38 is installed. The additional stirring roller 41 is arranged under the toner feeding roller 17 to contribute to a uniform mixing of the toner and the carrier. In order to simultaneously rotate the additional stirring roller 41, and the stirring roller 8, suitable gears (not shown) are installed between the gear 117 and a gear fixed on the shaft of the roller 41. The lid 11 is provide with a lever 50 and a microswitch 42, which outputs signals for indicating an open condition or closed condition of the lid 11. The lever 50 is fixed to the lid 11 and is normally set by a suitable spring catcher (not shown) so that the lid 11 closes the opening 18. The lever 50 is manually moved (rotated) to open the opening 18 by moving (rotating) the lid 11. Furthermore, on a guide 85 an empty container 43 (for a carrier) is set under the opening 18 and the lid 11 for receiving a discharged developing agent. The container 43 is made of plastic and has a nozzle 44 with a cap 45 (FIG. 8) which comes into contact with another microswitch 46, which outputs signals indicating a set or non-set condition of the cap 45. Furthermore, the developing agent holding vessel 3 is provided with a charging pipe 74 with a plastic cap 75 at a position corresponding to the flow regulating plate 10, as shown in FIG. 9. The plate 10 includes inclined plates 77 and the stirring roller 8 includes spiral blades 78, so that the toner and carriers are uniformly mixed.

In FIG. 6, a laser light 60 producing information for an electrostatic latent image is radiated on the charged surface of the photosensitive drum 1.

Figure 10A:
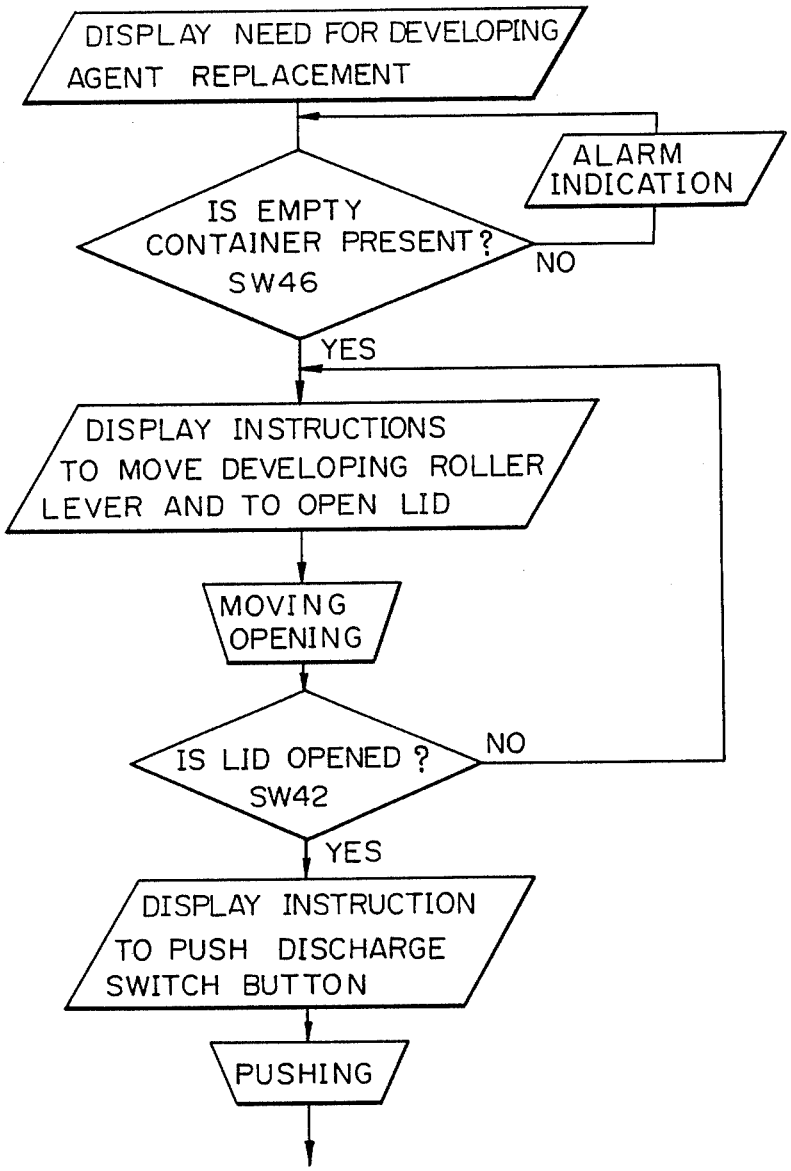
FIGS. 10A, 10B and 10C form a flow chart explaining the replacement of the developing agent.
Figure 10B:
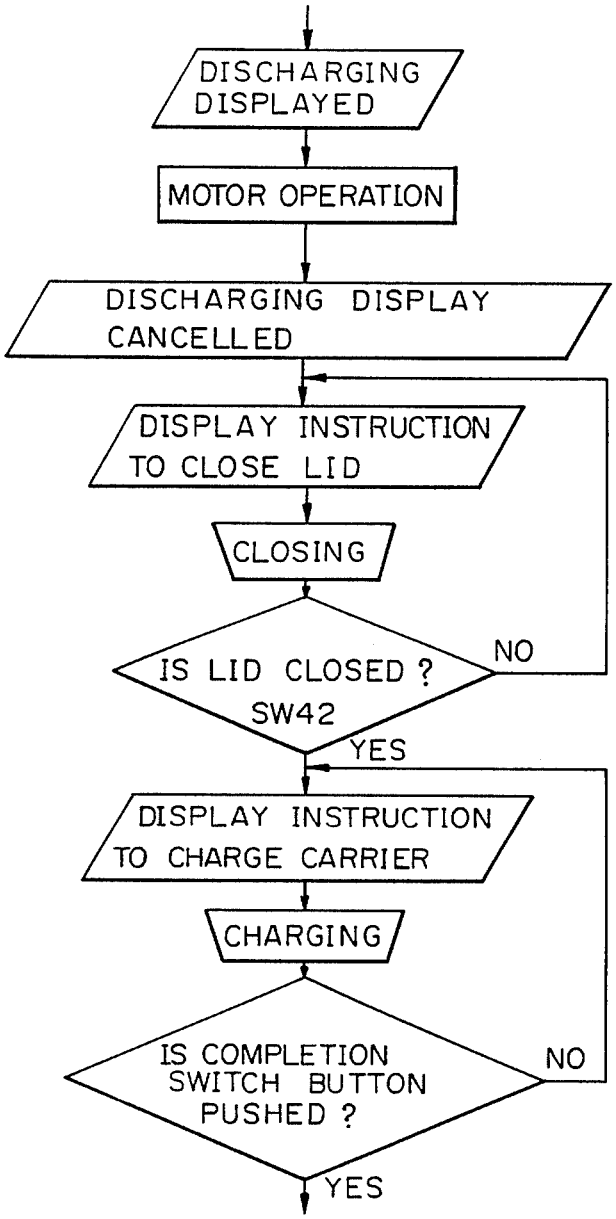
Figure 10C:
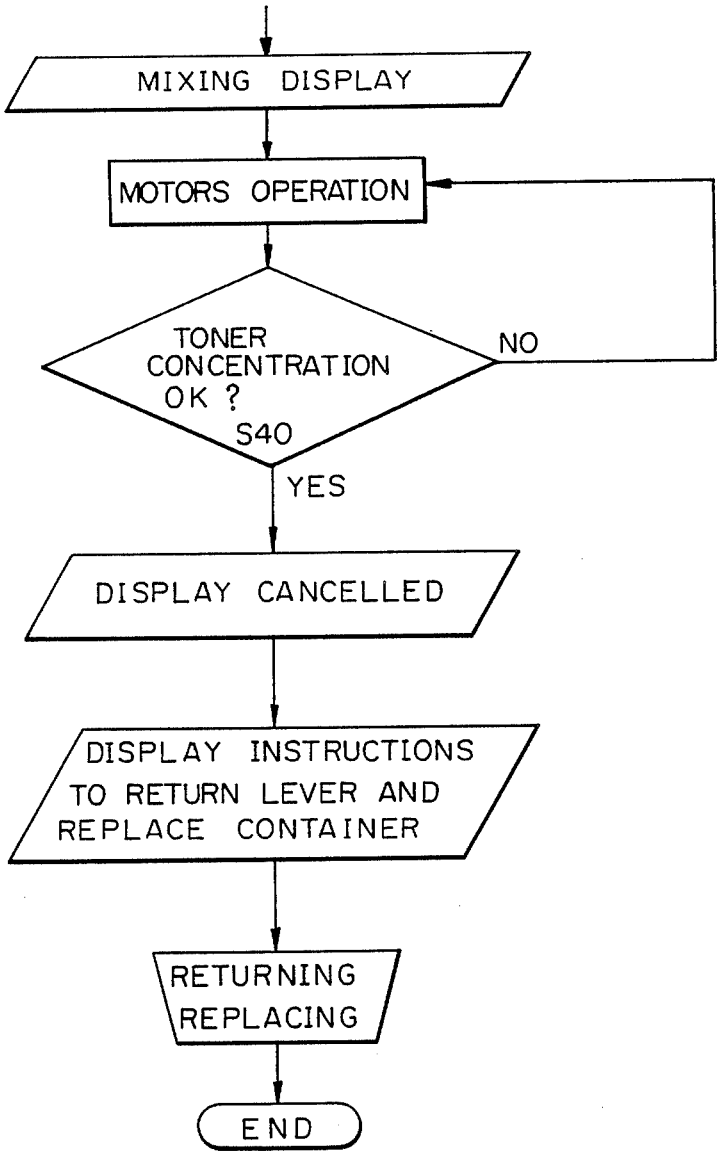
Figure 11:
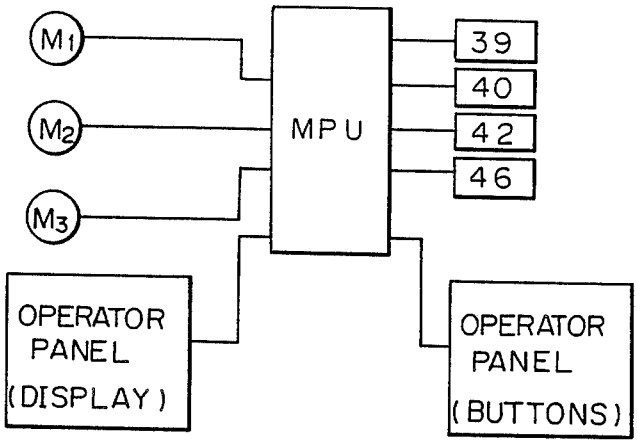
FIG. 11 is a block diagram of a control system for replacement.

FIG. 10 is a flow chart explaining the replacement of the developing agent, and FIG. 11 is a block diagram of a control system for the replacement.

Figure 12:
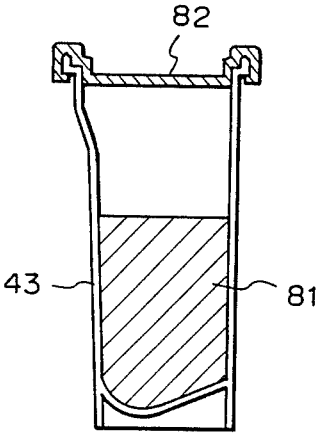
FIG. 12 is a sectional view of a new carrier container.

When the end of the predetermined service life of the carrier is reached, an indication that the developing agent must be replaced is automatically displayed on an operator panel of the electrophotographic printing apparatus. The user then brings a carrier container 43 containing a new carrier 81 therein, as shown in FIG. 12. This carrier container is the same as that of FIG. 8, and is covered with a suitable plastic cover 82. The user then pushes a button to confirm the replacement indication. When the empty container 43 is set in the developing device 30, a signal showing the presence of the container is sent from the microswitch 46 to a microprocessor unit (MPU in FIG. 11), so that the operator panel indicates instructions to move the lever 21 of the developing roller 7 and to open the lid 11. If the container 43 is not set, a signal showing the absence of the container is sent from the switch 46 to the MPU, and the panel sounds an alarm. In this case, the user must set the empty container 43 to the developing device 30, as shown in FIGS. 6 and 8.

The user then swings the lever 21 to rotate the magnetic roller 5, so that one of the magnetic poles facing the drum 1 is shifted and the developing agent brush does not come into contact with the drum surface, as explained hereinbefore, and then swings the lever 50 to rotate the lid 11, so that the opening 18 is opened. In this case, a signal showing the opening condition is sent from the microswitch 42 to the MPU, so that the panel displays an instruction to push a discharge switch button. If the user does not swing the lever 50 of the lid 11, a signal showing a closed condition thereof is continuously sent from the switch 42 to the MPU, and thus the indication "open lid" is continuously displayed.

Next, the user pushes the switch button, the panel indication is changed to—discharging—, and the motor $M_2$ (FIGS. 6 and 10) is actuated to rotate the magnetic roller 7, stirring roller 8, and the additional stirring roller 41, and the developing agent is discharged into the container 43 through the opening 18. After the rollers 7, 8 and 41 have rotated for a predetermined period, e.g., 30 seconds, the discharging indication is cancelled and an instruction to close the lid is displayed on the operator panel; i.e., the developing agent has been completely discharged.

The user returns (swings) the lever 50 to close the opening 18 with the lid 11. In this case, a signal showing the closed condition is sent from the microswitch 42 to the MPU, and the panel displays an instruction to charge a new carrier. If the lid 11 is not moved and the opening 18 remains open, the opening condition signal is sent from the switch 42 to the MPU, and the display of an instruction to close the lid remains.

The user removes the cap 75 of the charging pipe 74 (FIG. 9). Then, the user takes off a nozzle cap 45 of the new carrier container 43, inserts the nozzle 44 thereof into the charging pipe 74 of the developing agent holding vessel 3, and charges the new carrier 81 into the vessel 3 as shown in FIG. 9. After charging, the user puts the cap 75 on the pipe 74 and pushes a switch button to confirm that the charging operation is completed, and thus the panel display is charged to—mixing—and the motor $M_2$ for rotating the rollers 7, 8, and 41 and the motor $M_3$ (FIG. 6) for the toner feeding roller 17 are actuated. If the user does not push the switch button, the instruction to charge the carrier is still displayed. Since the toner is fed into the new carrier from the toner holding vessel 4 through the feeding roller 17 and the toner and carrier are mixed by the rollers 7, 8 and 41, the toner concentration of the developing agent is increased. When the toner concentration reaches a predetermined value, the sensor 40 sends a signal to the MPU, so that the motors $M_2$ and $M_3$ are stopped since the mixing is completed. At the same time, the mixing indication is cancelled and the panel displays an instruction to return the lever 21 of the magnetic roller 5 and to replace the container 43 containing the used developing agent.

The user then returns (swings) the lever 21, to return the magnetic pole to the position fixing the photosensitive drum 1, replaces the cap 45 on the nozzle 44 of the new empty container 43, and takes off the cover 82, takes the full container 43 from the developing device 30, and then puts the cover 82 on the full container 43. The empty container 43 is then put on and slided along the guide 85, so as to insert it into the device 30, and thus the replacement process of the developing agent is completed.

The above procedure makes the conventional moving mechanism for the developing device 20 unnecessary, and thus the structure of the developing device is simplified. It also becomes unnecessary to manually move the heavy developing device 2 (of 8–10 kg), since according to the present invention, the magnetic roller 5 is easily rotated by the lever 21, and further this mechanism for magnetic roller rotation has a simple construction.

It will be obvious that the present invention is not restricted to the above-mentioned embodiments and that many variations are possible for persons skilled in the art without departing from the scope of the invention.

What is claimed is:

1. A developing device for use with a photosensitive drum having a surface, comprising:

a developing agent holding vessel for holding a developing agent;

a developing roller consisting of a rotating non-magnetic sleeve and a magnetic roller which is surrounded by said rotating non-magnetic sleeve and has magnetic poles;

a blade disposed at an outlet of said developing agent holding vessel for uniformizing a feed quantity of the developing agent; and a stirring roller for stirring the developing agent, the developing agent consisting of a toner and a carrier in said developing agent holding vessel, said developing roller being provided with a moving means for shifting a position of said magnetic poles of said magnetic roller between an operating position and a developing agent replacement position, whereby in the operating position one of said magnetic poles faces the surface of the photosensitive drum during normal use of the developing agent, and no magnetic pole faces the surface of the photosensitive drum when said magnetic poles of said magnetic roller are in the developing agent replacement position.

2. A developing device according to claim 1, wherein said moving means comprises a lever fixed to said magnetic roller, and wherein said lever is swung to rotate said magnetic roller so that one of said magnetic poles in shifted from the facing position to the non-facing position and to rotate said magnetic roller so that the one of said magnetic poles is shifted from the non-facing position to the facing position.

3. A developing device according to claim 2, wherein said magnetic roller and said magnetic poles are rotated through an angle of approximately 50°.

4. A developing device according to claim 2, wherein when said magnetic poles of said magnetic roller are in the developing agent replacement position, another of said magnetic poles faces said blade.

5. A developing device for use with a developing agent and a photosensitive drum having a surface, comprising:

a developing roller positioned adjacent the surface of the photosensitive drum, including:

a magnetic roller having magnetic poles; and a rotating non-magnetic sleeve surrounding said magnetic roller; and moving means for rotating said magnetic roller to shift the position of the magnetic poles of said magnetic roller with respect to the surface of the photosensitive drum between an operating position and a developing agent replacement position, a predetermined one of the magnetic poles facing the surface of the photosensitive drum when the magnetic poles of said magnetic roller are in the operating position during normal operation of said developing device, said moving means shifting the magnetic poles so that none of the magnetic poles face the surface of the photosensitive drum when the magnetic poles of said magnetic roller are in the developing agent replacement position.

6. A developing device according to claim 5, wherein said moving means comprises a lever extending from said magnetic roller, and wherein said lever is actuated to rotate said magnetic roller so that the predetermined one of the magnetic poles is shifted from a position facing the surface of the photosensitive drum to a position in which it does not face the surface of the photosensitive drum.

7. A developing device according to claim 6, wherein said lever rotates said magnetic roller through an angle of substantially 50°.

8. A developing device according to claim 6, further comprising a blade disposed adjacent said developing roller, wherein one of the magnetic poles faces said blade when the magnetic poles of said magnetic roller are in the developing agent replacement position.

9. A developing device according to claim 5, further comprising a developing agent holding vessel having an opening for discharging the developing agent, and having a movable lid having a first position in which the opening is exposed and a second position in which the opening is covered.

10. A developing device according to claim 9, further comprising a removable container positioned adjacent the opening of said developing agent holding vessel, for receiving the developing agent discharged from the opening.

11. A developing device according to claim 5, further comprising:

a stirring roller for agitating the developing agent;
a motor for rotating the stirring roller; and
input means for actuating the motor.

12. A developing device according to claim 11, further comprising:

a developing agent holding vessel having an opening for discharging the developing agent and having a movable lid having a first position in which the opening is exposed and a second position in which the opening is covered; and a switch, coupled to said movable lid and said input means, for detecting whether said movable lid is in the first or second position, and for providing a detection signal to said input means.

* * * * *